US007814728B2

(12) United States Patent
Stroppiana

(10) Patent No.: US 7,814,728 B2
(45) **Date of Patent: *Oct. 19, 2010**

(54) FLOORING MATERIAL, METHODS FOR PRODUCING AND LAYING SAME

(75) Inventor: Fernando Stroppiana, Grinzane Cavour (IT)

(73) Assignee: Mondo S.p.A., Alba Frazione Gallo (Cuneo) (IT)

( * ) Notice: Subject to any disclaimer, the term of this patent is extended or adjusted under 35 U.S.C. 154(b) by 813 days.

This patent is subject to a terminal disclaimer.

(21) Appl. No.: 11/534,419

(22) Filed: Sep. 22, 2006

(65) Prior Publication Data

US 2007/0074486 A1 Apr. 5, 2007

(30) Foreign Application Priority Data

Sep. 22, 2005 (EP) ..... 05425663

(51) Int. Cl.
*E04C 2/00* (2006.01)
*E04B 1/82* (2006.01)

(52) U.S. Cl. ..... 52/782.1; 181/291

(58) Field of Classification Search ..... 52/782.1; 181/284, 291

See application file for complete search history.

(56) References Cited

U.S. PATENT DOCUMENTS 2,517,724 A * 8/1950 Schuh ..... 428/74
2,552,159 A * 5/1951 Eason ..... 52/98
4,489,115 A 12/1984 Layman et al.
4,989,688 A * 2/1991 Nelson ..... 181/287
5,132,163 A * 7/1992 Leaderman et al. ..... 428/192
5,272,284 A * 12/1993 Schmanski ..... 181/210
6,027,674 A * 2/2000 Yates ..... 264/113
6,221,456 B1 * 4/2001 Pogorski et al. ..... 428/69
6,319,441 B1 * 11/2001 Yates ..... 264/113
6,413,455 B1 * 7/2002 Yates ..... 264/51
6,498,199 B1 * 12/2002 Yates ..... 521/54
6,555,214 B1 * 4/2003 Yates ..... 428/314.4
6,623,847 B2 * 9/2003 Yates ..... 428/314.4
6,872,755 B1 * 3/2005 Yates ..... 521/54
6,877,535 B1 4/2005 Bennington ..... 144/235
6,887,535 B2 * 5/2005 Stroppiana ..... 428/17

(Continued)

FOREIGN PATENT DOCUMENTS

DE 17 84 769 A1 8/1971

(Continued)

OTHER PUBLICATIONS

European Search Report for EP 05 42 5663.1-2303, dated Mar. 3, 2006.

(Continued)

*Primary Examiner*—Richard E Chilcot, Jr.
*Assistant Examiner*—Andrew J Triggs
(74) *Attorney, Agent, or Firm*—Heslin Rothenberg Farley & Mesiti P.C.; Victor A. Cardona, Esq.

(57) ABSTRACT

A flooring material comprises a core layer of resilient granular agglomerate and a membrane that envelops the aforesaid core layer. In a preferred way, the material is in the form of modules, such as strips or tiles and the membrane forms, on at least one side of the modules, a selvage, which can be applied in a relationship of overlapping with at least one adjacent module.

33 Claims, 3 Drawing Sheets

U.S. PATENT DOCUMENTS

| | | | | |
|---|---|---|---|---|
| 7,060,334 | B2 * | 6/2006 | Stroppiana | 428/17 |
| 7,585,555 | B2 * | 9/2009 | Stroppiana | 428/95 |
| 2001/0023007 | A1 * | 9/2001 | Leriget | 428/68 |
| 2002/0058135 | A1 * | 5/2002 | Yates | 428/304.4 |
| 2004/0074208 | A1 * | 4/2004 | Olson et al. | 52/794.1 |
| 2005/0003193 | A1 * | 1/2005 | Stroppiana | 428/407 |
| 2007/0074486 | A1 * | 4/2007 | Stroppiana | 52/782.1 |

FOREIGN PATENT DOCUMENTS

| | | | |
|---|---|---|---|
| DE | 40 11 599 | A1 | 10/1991 |
| DE | 195 21 944 | A1 | 12/1995 |
| EP | 0 093 008 | A | 11/1983 |
| EP | 1 158 099 | A2 | 11/2001 |
| EP | 1 319 753 | A2 | 6/2003 |
| EP | 1 371 779 | A1 | 12/2003 |
| EP | 1 375 750 | A1 | 1/2004 |
| EP | 1 486 613 | A1 | 12/2004 |
| EP | 1 555 097 | A1 | 7/2005 |
| FR | 2 763 880 | A | 12/1998 |

OTHER PUBLICATIONS

Translation of Dec. 11, 2009 Notification of Second Office Action from corresponding Chinese Application No. 200610153042.4.

* cited by examiner

FLOORING MATERIAL, METHODS FOR PRODUCING AND LAYING SAME

CROSS-REFERENCE TO RELATED APPLICATIONS

This application claims priority from EP 05425663.1, filed Sep. 22, 2005, the entire disclosure of which is incorporated herein by reference.

BACKGROUND OF THE INVENTION

The present invention relates to flooring materials.

The invention has been developed with reference to a wide range of possible applications.

SUMMARY OF THE INVENTION

In particular, the material according to the invention is suited for being used as elastic substrate usable together with floorings for sports activities, both for indoor applications and for outdoor applications.

For example, the material described herein is suitable for being used as resilient (elastic) substrate together with synthetic grass coverings of the type described in U.S. Pat. No. 6,877,535 (which corresponds to EP-A-1 158 099). These are substantially synthetic grass coverings comprising a laminar sheetlike base with a plurality of filiform formations extending from the substrate for simulating the grassy sward of natural turf and a particulate filling material, or infill, dispersed between the filiform formations so as to keep the filiform formations themselves in a substantially upright condition. The particulate filling material (infill) is constituted by a substantially homogeneous mass of a granular material chosen in the group constituted by polyolefin-based materials and by vinyl polymer-based materials.

Further advantageous developments of this solution are described in the documents Nos. EP-A-1 319 753, EP-A-1 375 750, EP-A-1 371 779, as well as EP-A-1 486 613, all of said documents being filed in the name of the present applicant.

In addition to providing a controlled elastic substrate, suitable for all sports activities, the material according to the invention is moreover, usable also for rehabilitation of subjects who have undergone traumas and/or surgical operations and for areas of safety in children's playgrounds.

Another interesting sector of possible application of the material described herein is constituted by the industrial sector, where the material described can be used, for instance, for making temporary floorings on work sites or similar working environments, i.e., in conditions in which the flooring is exposed to considerable stresses, such as for example ones deriving from the transit of vehicles, such as dumpers, fork-lift trucks, etc.

Specifically, the invention relates to a flooring material comprising a core layer constituted by an agglomerate (or conglomerate, the two terms being used equivalently herein) of resilient particulate (i.e., granular) material. As is known, by "agglomerate (or conglomerate) material" is in general meant a material in the form of grains or powder gathered in a mass or coherent amalgamation.

Flooring materials of this type, with a base, for example, of granules of elastic polymers, EPDM, and various other types of artificial and synthetic rubbers, and elastomers of various nature, are well known to the art. As agglomerating agent, usually bicomponent polyurethane is used or, in more recent applications, monocomponent polyurethane. Flooring materials that fall within the category described above are known in the art, as demonstrated, for example, by the products of the range REGUPOL™, manufactured by the company Berleburger Schaumstoffwerk GmbH (E.U.) or, once again by way of example, by EP-A-1 555 097.

These known materials are usually in the form of slabs or tiles of various thickness and dimensions. The operation of laying usually envisages that the material in question is glued on a more or less levelled foundation or subfloor, and thus possibly functions as laying substrate for a further layer of flooring, glued on the layer of granular-agglomerate material.

This solution is, however, exposed to a series of drawbacks.

In particular, the nature of the material (resilient granular agglomerate) means that the material itself is readily exposed to the undesirable dispersion of granules. This drawback is particularly felt in those applications in which the material is subjected to considerable stresses (previously, reference was made to the example of the possible transit of vehicles).

The need to glue the material on the foundation in order to keep it in the desired position is a factor not appreciated in all those applications in which the material is to be laid only temporarily. In particular, when the material glued on the foundation is to be removed, it may easily happen that the action of detaching the body of the material from the foundation leaves in place quite an extensive amount of granules or clusters of granules firmly glued to the foundation. The operation of removal must hence be completed with an action of scraping aimed at detaching said granules or clusters of granules from the foundation. In addition to implying a cost in terms of time and money, this operation can lead to undesirable damage of the foundation, for instance, in the case of a pre-existing flooring (for example a high-quality wood or stone flooring), which it was intended to protect from damage precisely with the laying of the granular-agglomerate material as layer of protection.

Other drawbacks are linked to the areas of connection between adjacent slabs, which are liable to constitute real gaps with a character of discontinuity of the flooring. These discontinuities are appreciable both from the mechanical standpoint, i.e., as regards tread resistance, and from the standpoint of behaviour of the flooring in regard to damp, this latter aspect being of considerable importance in general on account of the characteristics demonstrated by the flooring as a whole, both as regards the need to ensure a flooring that presents good characteristics of drainage in regard to rainwater (in outdoor applications) and as regards the possibility of making floorings that function as barriers against rising damp from the ground (in indoor applications).

The purpose of the present invention is to provide a flooring material capable of meeting in a co-ordinated way all the needs outlined previously.

According to the present invention, said purpose is achieved thanks to a flooring material having the characteristics referred to specifically in the ensuing claims.

The invention relates also to a corresponding method of production and a corresponding method of laying.

BRIEF DESCRIPTION OF THE DRAWINGS

The invention will now be described, purely by way of non-limiting example, with reference to the annexed plate of drawings, in which.

DETAILED DESCRIPTION OF THE DRAWINGS

Figure 1:
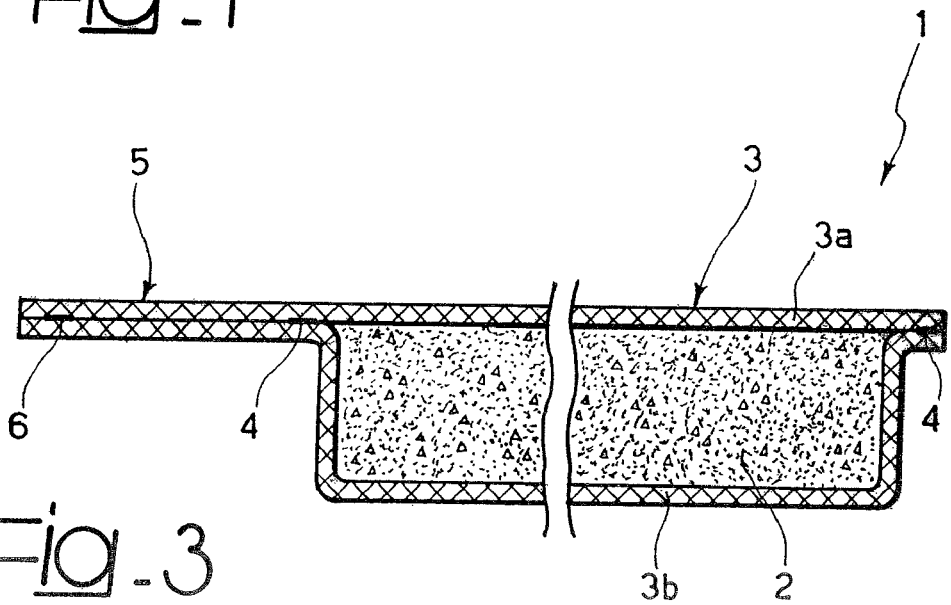
FIG. 1 is a cross-sectional view of the flooring material of the type described herein.

In the figures of the annexed plate of drawings, the reference number 1 indicates as a whole a flooring material usable, for example, for any of the applications to which reference is made in the introductory part of the present description.

The material 1 is produced in the form of "modules" constituted, in the examplary of embodiment illustrated herein, by strips that can be unrolled onto a foundation or subfloor S so that they are laid alongside one another and connected together according to the criteria described in greater detail in what follows. In any case, even though the embodiment in the form of strips constitutes the currently preferred choice, the solution according to the invention is suited for making modules in the form of slabs or tiles.

The material 1 comprises a core 2 constituted in general by a granular material with a base of resilient material.

The above resilient material may be constituted, as has already been said in the introductory part of the present description, by material consisting of granules of elastic polymer, rubber of various nature (for example, EPDM) and, in a preferred embodiment, by granular material obtained from recycled tyres.

The granular material constituting the core layer 2 is an agglomerate (or conglomerate, the two terms, as has been said, being used herein as equivalent) with the application of a binder constituted, for example, by bicomponent polyurethane or monocomponent polyurethane. As has already been said in the introductory part of the present description, materials of this type are known to the art, a fact that renders any more detailed description herein superfluous.

As regards the binder used for providing the core material 2 with characteristics of agglomerate/conglomerate, it should be recalled that the choice of a binder such as polyurethane, albeit deemed currently preferential, is not in any way imperative. Thus included within the sphere of the present invention is the use of binders of a different type. In a possible variant embodiment of the invention (currently not considered preferred), the state of agglomeration can be achieved by exploiting the characteristics of cohesiveness demonstrated by certain resilient materials (such as certain rubber materials). In this case, it is conceivable to do without the use of binders and to bestow upon the layer 2 the necessary characteristics of mechanical coherence by simply subjecting the granular material to compression.

Just to clarify our ideas (without this implying any limitation of the scope of the invention), the granules constituting the layer 2 can have a grain size in the range of 0.5-7 mm in the case of floorings designed for outdoor applications, and a grain size that is slightly smaller, in the range of 0.5-5 mm, for indoor applications.

Of course, the dimensional values indicated previously (as all the other quantitative data provided in the present description and in the ensuing claims) are to be understood as being assigned taking into account the tolerances normally associated to production requirements and to measurement of said quantitative values.

The amount of binder (for example, bicomponent polyurethane or monocomponent polyurethane) used for making the core layer 2 normally lies in the range of 2-10 wt % (with respect to the weight of the granules) in the case of outdoor applications and in the range of 5-15 wt % (referred to the weight of the granules) for indoor applications.

An important characteristic of the solution described herein lies in the fact that the core layer 2 is not "bare", but coated with a membrane or envelope 3 that coats the core layer 2.

For reasons that will emerge more clearly in what follows, the action of coating of the core layer 2 performed by the membrane 3 is complete or substantially complete, in the sense that, in the case where the material 1 is made in the form of strips designed to be wound in rolls, the membrane 3 can envelop the core layer 2 completely, or else leave out one or both of the two terminal ends of the strip.

In the case where the "modules" in which the material 1 is made are in the form of slabs or tiles, for example of square shape, the membrane 3 can be re-closed (according to the modalities described in greater detail in what follows) in areas corresponding to all the sides of the module, thus performing an action of complete coating (or "encapsulation") of the core layer 2, or else remain open on one side or on two opposite sides.

In the case of modules in the form of strips (i.e., of narrow and long slabs), once again the membrane 3 can have a tubular structure, and hence coat the core layer 2 over the entire development of the module with the exception of the two smaller end sides of the strip. Albeit preserving the aforesaid tubular structure, the membrane 3 can, however, coat the core layer 2 over the entire development of the module with the exception of the two smaller end sides of the strip.

The choice of providing an altogether complete coating or encapsulation or else of leaving uncovered (for example, in view of a possible coating in the course of laying) small fractions of the boundary of the core layer 2 is evidently dictated by the specific conditions of application considered. In any case, the possible presence of small portions of edge of the core layer 2 left uncovered does not alter the global effect of coating of the layer 2 by the membrane 3.

Again, without prejudice to the achievement of the desired effect of envelopment of the core layer 2, according to the geometrical characteristics of the modules that constitute it, the membrane 3 can be made according to different criteria.

For example, two solutions referred to herein for reasons of completeness, but currently not considered preferred, envisage that, in the case where the material 1 is made in the form of a strip, the membrane 3 is made in the form of a single sheet with a continuous tubular structure, fitted around the core layer 2 and fixed to it according to the modalities described in greater detail in what follows, or else constituted by a single originally open sheet that is wound to form a U around the core layer 2 and then closed—usually along one of the longitudinal edges of the strip—so as to provide a tubular structure that envelops the core layer 2.

The figures of the annexed plate of drawings refer to the currently preferred embodiment. In this case, the membrane 3 is constituted by a plurality of sheets (identical to of different from one another), such as, for example, two sheets 3*a* and 3*b* that extend in areas corresponding to the main opposite faces of the core layer 2 and are re-closed along the sides thereof (i.e., along the longitudinal edges of the strip, in the case where the flooring 1 is made in the form of a strip) in areas corresponding to the lines of closing or sealing designated by 4.

In the example illustrated in FIG. 1 (again corresponding to the embodiment of the invention that is currently preferred), the two lines of closing 4 are basically coplanar with on of the faces of the core layer 2, so that the sheet 3*a* is substantially plane whilst the sheet 3*b* has a general C-shaped or channel-shaped conformation.

The above choice is not, however, in any way imperative.

The lines 4 could in fact be provided, for example, in an area corresponding to an intermediate plane (for example, a middle plane, which is vertical, as viewed in FIG. 1) of the layer 2, or else could be provided, one in an area corresponding to one of the faces of the core layer 2, and the other in an area corresponding to the opposite face of the same core layer 2.

In particular, in the embodiment represented in FIG. 1, on one of the sides of the material 1 (but the same solution could be contemplated in areas corresponding to two or more of the sides of each module of material 1), it is envisaged that the sheets 3*a*, 3*b* extend so as to form a selvage 5, usually reinforced, at least in an area corresponding to its distal edge, by at least another line of closing or sealing, designated by 6.

Figure 5:
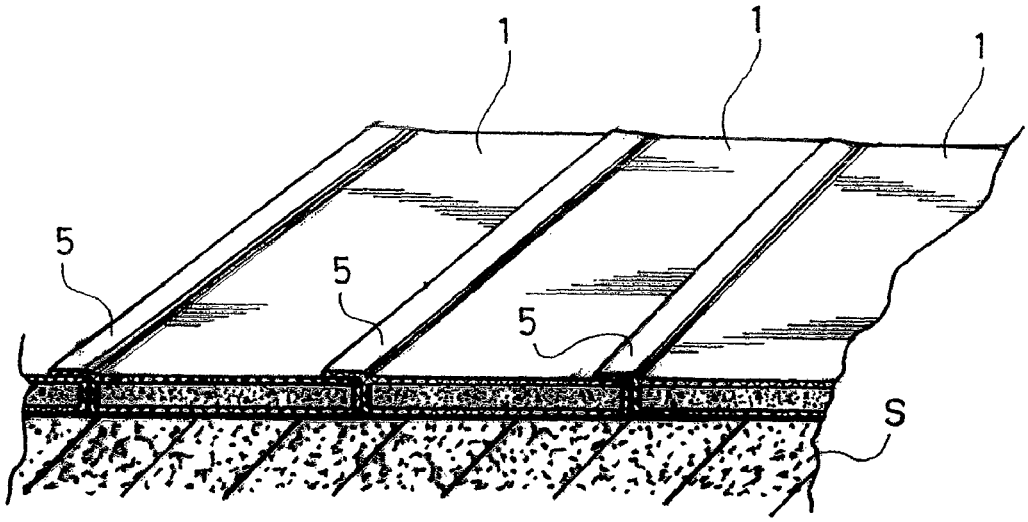
FIG. 5 is a schematic illustration of the method of laying of the material described herein.

As has already been said, a selvage such as the selvage designated by 5 in FIG. 1 (and designed to enable connection of a number of flooring modules together, according to the criteria described in greater detail in what follows with reference to FIG. 5) can be provided on two or more of the sides of each flooring module 1.

For example, in the case where this module is constituted by a square tile, a selvage such as the selvage 5 can be provided on two adjacent sides of the square.

Again, in the example of embodiment illustrated in FIG. 1 the selvage 5 is represented as formed by an extension of both of the sheets 3*a* and 3*b* of the membrane that coats the core layer 2. However, the selvage 5 could in itself be formed also by only one of these sheets (for example, just by the sheet designated by 3*a*).

A preferred choice for making at least one of the sheets 3*a*, 3*b* of the membrane (i.e., of at least one part of the membrane 2) is constituted by a nonwoven-fabric material (NW). This may be a material of the type commonly known as continuous-thread nonwoven geotextile material, obtained with a processing of a needled-felt type. A material of this sort may to advantage be polyester-based.

The material of the membrane 3 can have, for example, a mass per unit area (according to the standard UNI EN ISO965) of 50-400 g/m$^2$, typically 150 g/m$^2$.

The data regarding the mass per unit area provided show that the total mass per unit area of the material 1 is mainly represented by the characteristics of the core layer 2, which is usually far heavier than the membrane 2.

Just to clarify our ideas, materials 1 designed for outdoor applications typically have a thickness of 20-40 mm, with a mass per unit area of 13-14 kg/M$^2$ for the thickness of 25 mm, hence with a mean distribution of 0.5-0.6 kg/m$^2$ per millimeter of thickness.

For indoor applications, instead, as a whole thinner materials are favoured, typically with a thickness in the region of 4-15 mm, with a mass per unit area corresponding to a mean distribution of 0.5-0.6 kg/m$^2$ per millimeter of thickness.

The choice, for the membrane 3, of a material of the type described previously is advantageous in so far as the aforesaid material is heat-sealable, and thus enables providing lines of closing 4 (and 6, if present) via heat sealing with the localized application of heat. Alternatives to making said sealing or welding lines are of course represented by the application of glue or by ultrasound welding.

Another important characteristic of the material of the type described above is represented by the fact that, via the joint application of heat and pressure during fabrication of the flooring material 1 (according to the modalities described in greater detail in what follows), it is possible to obtain a firm anchorage of the sheets of the membrane 3*a* and 3*b* on the opposite faces of the core layer 2. The term "firm anchorage" is of course meant to indicate the condition in which the membrane 3 is fixed to the core layer 2 and hence cannot be either removed or made to slide with respect to the core layer 2 unless stresses are applied higher than the ones envisaged in use.

Of course, albeit in a less preferred way, said anchorage can alternatively be achieved with the application of layers of adhesive material.

In any case, the fact that the sheets 3*a*, 3*b* of the membrane are fixed to the core layer 2 (at least as regards the major faces thereof) is important for ensuring the dimensional stability of the flooring 1.

Another advantage demonstrated by the geotextile material of the type described previously is represented by the fact that it is able to receive easily on the upper face and/or on the underface of the flooring a layer of adhesive material used for connecting the material 1 firmly to a laying foundation and/or for connecting a further layer of flooring firmly on top of the flooring material 1.

It will any way be appreciated that in the case (which, for reasons that will emerge more clearly in what follows, is not imperative) where the material 1 is glued on a foundation, the possible removal of the material 1 entails detachment thereof—as a whole—from the laying foundation, without there remaining thereon residual granules of the layer 2 in so far as the layer 2 is lined by the membrane 3.

Again, the materials described previously for making the membrane 3 have the advantage of being able to be made in the form of materials permeable to water, the aim being to bestow upon the material 1 as a whole good characteristics of drainage. Said characteristics is important for outdoor applications.

The choice of the materials described previously is not, however, in any way imperative and can be changed according to specific needs of application.

In particular, different parts of the membrane 3 (for example, the sheets 3*a* and 3*b* visible in FIG. 1) can be made with different materials. For example, it is possible to use, for the top sheet, a material of the type described previously, using, instead, for the bottom sheet, a material that by its nature (or as a result of a treatment to which it has been subjected) has characteristics of impermeability in regard to water and damp. This choice can be adopted, for example, in indoor applications, in which there may occur rising damp starting from the laying foundation. In this case, the fact that the bottom sheet—lying directly on the laying foundation—presents characteristics of impermeability means that the flooring material 1 will provide an effective barrier in regard to rising damp.

Figure 2:
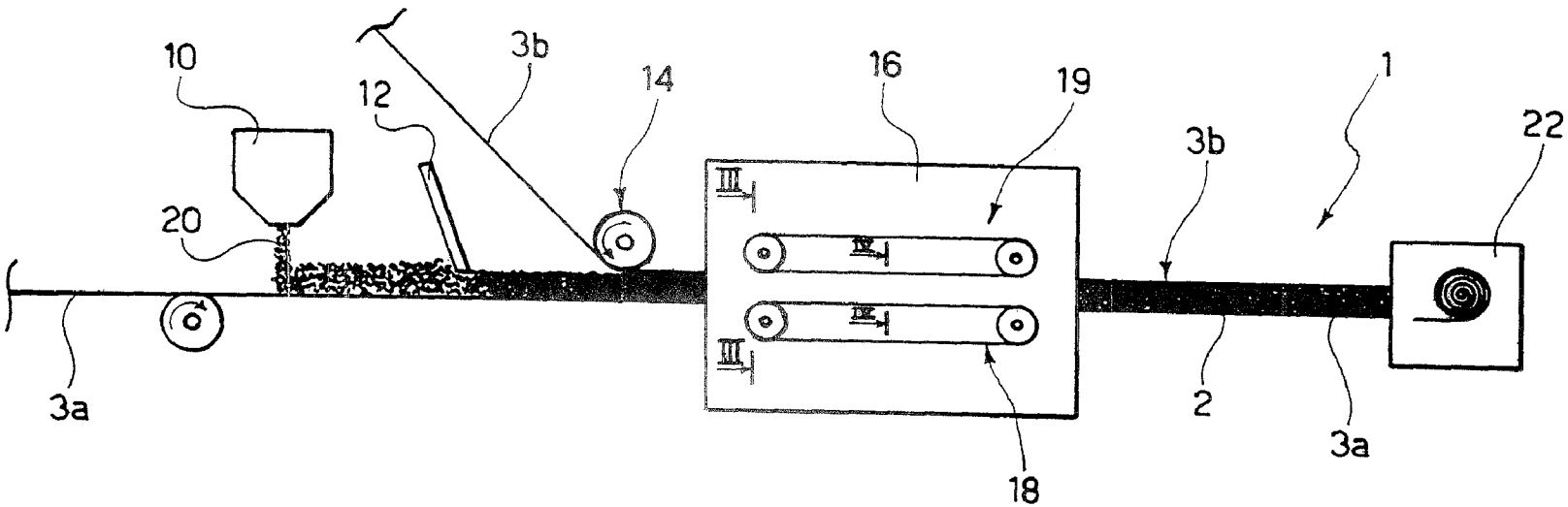
FIG. 2 is a functional block diagram that illustrates the main steps of a method for the fabrication of the flooring material illustrated in FIG. 1.

FIG. 2 is a schematic illustration of the possible criteria of fabrication of a flooring materials such as the material 1 of FIG. 1.

Persons skilled in the art will appreciate that, taken individually, the various processing operations (and the corresponding apparatuses used) described with reference to FIG. 2 correspond to operations normally performed and to apparatuses commonly available in plants for the production of floorings. All this renders it superfluous to provide herein a more detailed description, except as regards making the welding/sealing lines 4, 6 and the selvage 5.

Once more to provide (non-limiting) dimensional indications of an orientative character, the process described in this case with reference to FIG. 2 refers to the production of a flooring material 1 in the form of strips which have a width in the region of two meters and are provided, along one of the sides, with a selvage 5 having a width comprised between 2 and 6 cm, approximately.

The method of fabrication represented in FIG. 2 starts from the supply—from a source (such as a reel) of a known type—of the sheet 3*a* of the membrane 3. The sheet 3*a* is unrolled and made to advance in a substantially horizontal direction (from left to right, as viewed in FIG. 2), and then receives, "seeded" thereon, in a station designated as a whole by 10, the granular material 20 of the layer 2. The material 20 is seeded on the sheet 3*a* in a free state (hence not yet an agglomerate/conglomerate), but contains within it a thermoactivatable binder (for example, monocomponent polyurethane).

The reference 12 indicates a processing station substantially similar to a sort of doctor blade held suspended above the sheet 3*a* so as to adjust the thickness of the bed of granules 20 seeded thereon at the desired value according to the total thickness that it is intended to bestow upon the flooring material 1.

The reference number 14 designates a further processing station (basically a roller spreader), where the other sheet 3*b* of the membrane 3, coming from a source (for example a reel—not illustrated), is applied over the granules 20. There is thus created a sandwich structure, constituted, from the bottom upwards, by the sheet 3*a*, the bed of granules 20, and the sheet 3*b*.

The sandwich thus formed is substantially in the form of a composite weblike laminar material open on both of its longitudinal sides. This composite material is then fed into a processing station 16, substantially constituted by a continuous-band press that has the function of providing, through the simultaneous application of pressure and of heat, the following functions:

formation of the core layer 2 as a result of the heat-induced polymerization of the polyurethane binder already mixed to the granules 20;

formation of a firm surface bond between the opposite faces of the core layer 2 and the sheets 3*a*, 3*b* of the membrane 3; and closing of the membrane 3 in areas corresponding to the welding or sealing lines 4, with simultaneous formation of the selvage 5 (including the formation of the welding lines 6 associated thereto).

Figure 3:
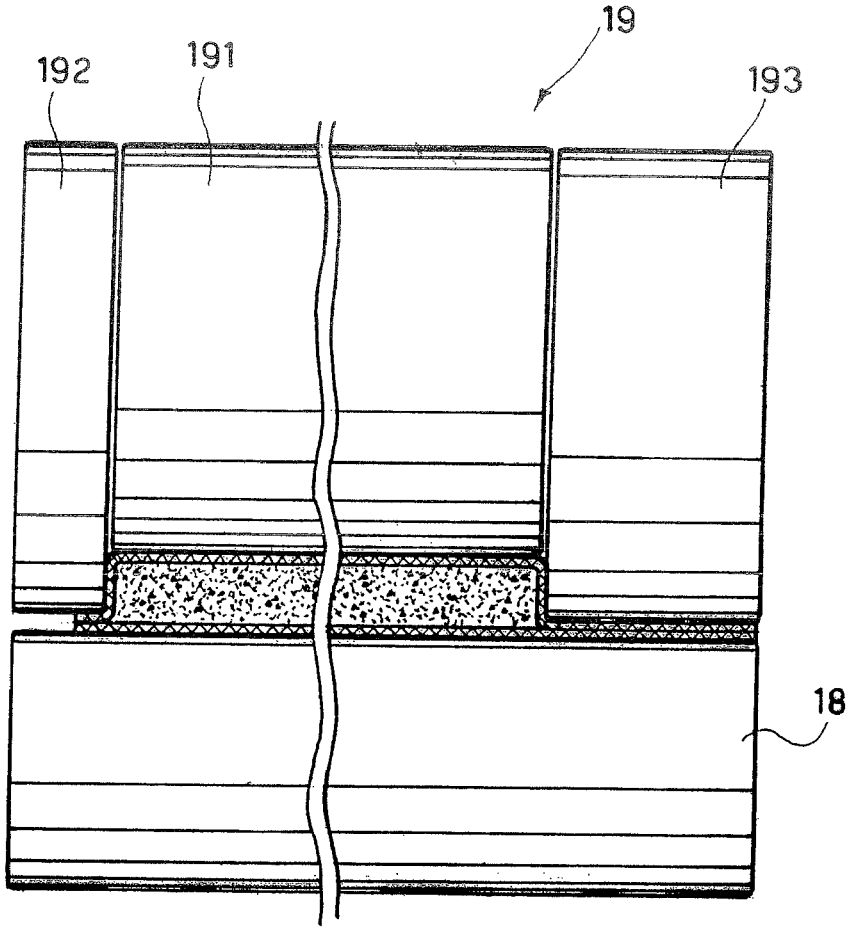
FIGS. 3 and 4 are two cross-sectional views according to the lines III-III and IV-IV, respectively, of FIG. 2.
Figure 4:
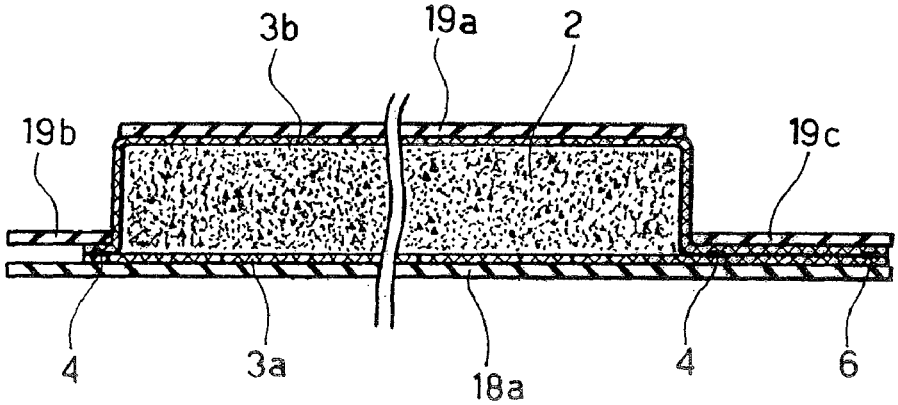

In the currently preferred embodiment, the band press 16 has the structure that can be inferred from the cross-sectional views of FIGS. 3 and 4.

In particular, the press in question has a bottom band 18 of a conventional structure, hence with a top pressing branch (18*a*, in FIG. 4), which is as a whole plane and acts against the sheet 3*a* of the membrane 3.

Unlike the band 18 (located usually in a lower position), the complementary band, designated as a whole by 19, has a more complex, tripartite, structure, as will be better appreciated from the cross-sectional views of FIGS. 3 and 4.

In particular, the band 19 is in actual fact constituted by three endless-loop bands 191, 192 and 193, of which the one located in a central position has an active branch 19*a* (see FIG. 4) designed to act on the sheet 3*b* in an area corresponding to the upper face of the core layer 2.

The two side pressing loops, designated by 192 and 193, instead, have respective active branches 19*b* and 19*c* (see again FIG. 4), which co-operate with the active branch 18*a* of the bottom pressing band so as to provide, on one side of the strip of flooring material 1, a first line of closing 4 and, on the opposite side, the other line of closing 4, as well as the selvage 5, including the further line or lines of closing 6 associated thereto.

The flooring material in the form of strip 1 coming out of the station 16 is then sent on to a winding station 22 for being gathered in the form of rolls.

A person skilled in the sector will readily understand that the basic system structure represented in FIG. 2 can be integrated by further elements for performing accessory functions (for example, finishing of one or both of the surfaces of the material 1, application of accessory layers, including releasing agents to facilitate unrolling of the material off the rolls, application of mould-repellent agents, etc.).

Of course, in the case where the material 1 is designed to be made in the form of slabs or tiles, there will in general be present a transverse-sectioning station designed to form the individual tiles, with possible formation of areas of closing in the membrane along the transverse sides thus formed.

FIG. 5 is a schematic illustration of the operation of laying of the material 1 described herein, with specific reference to the case where this is made in the form of strips. Extension to the case where the material is made in the form of tiles is evident and hence does not require any detailed illustration in the present context.

Basically, the strips of material 1 are unrolled and laid on the foundation S alongside one another in such a way as to cause the selvage 5 present on one side of each strip to be placed in a relationship of overlapping at the side (which is usually without any selvage) provided in the adjacent strip/module.

The selvages 5 that are thus in a relationship of overlapping are then fixed (for example, by gluing or heat sealing) each on the adjacent strip 1, thus giving rise to a continuous structure such as to present, precisely as a result of the sealing along the selvages 5, excellent characteristics of resistance and mechanical stability as a whole. Thanks to this stability, the material 1 described herein is suited for being laid on a foundation S even without needing to be connected thereto in an adhesive relationship.

The above characteristic is much appreciated in the case of materials 1 that are designed for temporary laying in so far as it facilitates the operations of removal: in practice, the material 1 designed to be removed is simply lifted away from the foundation and wound back on the roll. Again, the absence of adhesive connection means that the foundation S is not damaged, nor does it have any residue of adhesive bonding material. This characteristic is particularly appreciated in the case where such a foundation is constituted by a pre-existing flooring (such as a high-quality wood or stone flooring), the aim having been to protect it temporarily, for example while work is being carried out on a worksite.

At the same time, the effect of lining of the core layer 2 obtained using the membrane 3, as well as the firm mechanical connection between adjacent strips achieved thanks to the selvages 5, enables a flooring material to be obtained that is not only tread-resistant, but is also resistant to the transit of vehicles such as worksite vehicles.

According to the needs of application, the laying solution according to which the selvage 5 present on one side of a strip/module is placed in a relationship of overlapping at one side (which is usually without selvage) of the adjacent strip/module can be performed also in a condition that is turned over with respect to the conditions illustrated by way of example in FIG. 5.

FIG. 5 in fact illustrates a laying condition in which the various flooring strips are laid on the foundation S with an orientation like the one illustrated in FIG. 1, i.e., with the selvages 5 substantially aligned with the sheet 3*a* and hence with the upper face of the material 1. In this case, the selvage 5 present on one side of each strip overlaps the top side of the adjacent strip/module; i.e., it is set on top of said adjacent strip/module. The selvages 5 extend therefore on the top side of the flooring that has been laid, at a distance from the foundation S substantially equal to the thickness of the material 1, so that they remain in sight.

In the turned-over laying condition mentioned previously, the various strips of flooring are laid on the foundation S with an orientation such as the one illustrated in FIG. 4, i.e., with the selvages 5 substantially aligned with the sheet 3*a*, which in this case, however, defines the underface of the material 1, facing the foundation S. By adopting this laying condition, the selvage 5 present on one side of each strip overlaps the underside of the adjacent strip/module, i.e., the face underneath said adjacent strip/module. In this case, the selvages 5 extend on the underside of the flooring that is laid, in contact with the foundation S and hence hidden from sight by the flooring 1 itself.

Of course, without prejudice to the principle of the invention, the details of fabrication and the embodiments may vary widely with respect to what is described and illustrated herein purely by way of example, without thereby departing from the scope of the invention, as defined by the annexed claims.

The invention claimed is:

1. A flooring system comprising:

a plurality of modules, each module comprising:

a core layer of resilient granular agglomerate; and a membrane that envelops said core layer, said membrane forming a selvage on at least one side of each module of said plurality of modules, said selvage configured to overlap at least one adjacent module of said plurality of modules;

wherein each module of said plurality of modules comprises a strip with two terminal ends, and said membrane coats said strip except for said terminal ends.

2. The system according to claim 1, wherein each module of said plurality of modules is in the form of a slab or tile.

3. The system according to claim 1, wherein said membrane is fixed to said core layer.

4. The system according to claim 1, wherein said membrane consists of a single sheet.

5. The system according to claim 1, wherein said membrane comprises a plurality of sheets.

6. The system according to claim 5, wherein said plurality of sheets is made of materials that are identical to one another.

7. The system according to claim 5, wherein said plurality of sheets is made of materials different from one another.

8. The system according to claim 1, wherein said membrane is permeable to liquids, so that said system has characteristics of drainage.

9. The system according to claim 1, wherein said membrane is impermeable at least on one side of said core layer so that said system is able to function as barrier against dampness.

10. The system according to claim 1, wherein said membrane is heat-sealable.

11. The system according to claim 1, wherein said membrane comprises a non-woven fabric.

12. The system according to claim 11, wherein said non-woven fabric is of a continuous-thread needled geotextile type.

13. The system according to claim 1, wherein said membrane has a mass per unit area of 50-400 g/m$^2$.

14. The system according to claim 1, wherein said membrane has a mass per unit area of about 150 g/m$^2$.

15. The system according to claim 1, wherein said membrane is polyester-based.

16. The system according to claim 1, wherein the material has a thickness in the range of 4-15 mm.

17. The system according to claim 1, wherein the material has a thickness in the range of 20-40 mm.

18. The system according to claim 1, wherein the material has a mass per unit area in the range of 0.5-0.6 kg/m$^2$ per millimeter of thickness.

19. The system according to claim 1, wherein said core layer comprises resilient granular material with a grain size in the range of 0.5-7 mm.

20. The system according to claim 1, wherein said core layer comprises resilient granular material with grain size in the range of 0.5-5 mm.

21. The system according to claim 1, wherein said resilient granular material is chosen in the group consisting of elastic polymers, elastomers, rubbers, and recycled resilient materials.

22. The system according to claim 1, wherein said resilient granular material is granular material obtained from recycled tires.

23. The system according to claim 1, wherein said resilient granular material is agglomerated using a binder.

24. The system according to claim 23, wherein said binder is polyurethane.

25. The system according to claim 24, wherein said polyurethane is present in a percentage in the range of 2-10 wt%, relative to the weight of the granule.

26. The system according to claim 24, wherein said polyurethane is present in a percentage in the range of 5-15 wt%, relative to the weight of the granule.

27. A method for producing the flooring material of claim 1, the method comprising:

providing a first sheet of said membrane;

forming, on said first sheet, a bed of the resilient granular material of said core layer;

applying a second sheet of said membrane on said bed of resilient granular material;

performing the agglomeration of said resilient granular material so as to form said core layer; and connecting together said first sheet and said second sheet so as to form said membrane;

connecting a selvage to said membrane, the selvage configured to overlap at least one adjacent membrane.

28. The method according to claim 27, wherein the forming said bed of resilient granular material comprises the steps of:

disseminating said granular material on said first sheet; and selectively adjusting the thickness of granular material deposited on said first sheet.

29. The method according to claim 27, wherein the obtaining the agglomeration of said resilient granular material and the connecting together said first sheet and said second sheet so as to form said membrane are carried out in a substantially simultaneous way.

30. The method according to claim 29, further comprising applying pressure on said resilient granular material comprised between said first sheet and said second sheet so as to determine fixation of said membrane to said core layer.

31. A method for laying the system according to claim 1, the method comprising:

laying on a foundation or subfloor (S) in such a way that they are set alongside one another at least one first module and one second module of said material;

arranging the selvage carried by one of said modules in a relationship of overlapping with the other of said modules; and fixing said selvage to the other of said modules.

32. The method according to claim 31, further comprising arranging the selvage carried by one of said modules in a relationship of overlapping on top of the other of said modules.

33. The method according to claim 31, further comprising arranging the selvage carried by one of said modules in a relationship of overlapping underneath the other of said modules.

* * * * *